US010610800B2

(12) United States Patent
Adkins et al.

(10) Patent No.: US 10,610,800 B2
(45) Date of Patent: Apr. 7, 2020

(54) THROWN FLYING TOY THAT PRODUCES LIFT REGARDLESS OF DIRECTION OF ROTATION

(71) Applicant: Goliath Far East Limited, Tsim Sha Tsui, Kowloon (HK)

(72) Inventors: Mark A. Adkins, East Brunswick, NJ (US); Robert Romash, Colorado Springs, CO (US)

(73) Assignee: Goliath Far East Limited, Hong Kong (HK)

( * ) Notice: Subject to any disclaimer, the term of this patent is extended or adjusted under 35 U.S.C. 154(b) by 0 days.

(21) Appl. No.: 16/233,437

(22) Filed: Dec. 27, 2018

(65) Prior Publication Data

US 2019/0209942 A1 Jul. 11, 2019

Related U.S. Application Data

(60) Provisional application No. 62/615,428, filed on Jan. 9, 2018.

(51) Int. Cl.
*A63H 33/18* (2006.01)
*A63F 9/02* (2006.01)

(52) U.S. Cl.
CPC ..... *A63H 33/18* (2013.01); *A63F 9/0278* (2013.01); *A63F 2009/0286* (2013.01)

(58) Field of Classification Search
CPC A63H 33/18; A63F 9/0278; A63F 2009/0286
USPC ..... 446/46
See application file for complete search history.

(56) References Cited

U.S. PATENT DOCUMENTS 862,094 A * 7/1907 Morton ..... A63H 27/12 446/36
2,640,296 A * 6/1953 Johnson ..... A63H 27/12 446/40
4,203,249 A 5/1980 Bohm
4,284,278 A * 8/1981 Bradford ..... A63B 65/08 244/198
4,307,535 A 12/1981 Martin
4,479,655 A * 10/1984 Adler ..... A63B 65/08 473/589
5,041,042 A * 8/1991 Stein ..... A63H 33/18 446/15
5,213,539 A 5/1993 Adler
5,615,892 A * 4/1997 Miller ..... A63B 65/08 446/36

(Continued)

*Primary Examiner* — Michael D Dennis
(74) *Attorney, Agent, or Firm* — LaMorte & Associates P.C.

(57) ABSTRACT

A flying toy that is thrown into flight. The flying toy has a central hub with a central axis. A central opening is formed in the hub. Wings radially extend from the central hub. Each of the wings has a first section that extends from the hub, a second section that extends from the hub, and a curved section that joins the first section to the second section. A shaped opening is defined in each of the wings. The curved section in each of the wings is shaped as an airfoil. The curved sections produce lift as air flows over the curved sections in flight. The openings in the hub and the wings enable air to flow over the air foils regardless to flight speed or rotational speed. The shape of the flying toy also produces an air cushion in flight that supplements lift.

19 Claims, 6 Drawing Sheets

(56) References Cited

U.S. PATENT DOCUMENTS

| | | | | |
|---|---|---|---|---|
| 5,868,597 | A * | 2/1999 | Chen | A63H 1/32 446/46 |
| 6,468,123 | B1 * | 10/2002 | Valencia | A63H 33/18 446/48 |
| D724,156 | S * | 3/2015 | Fisher | D21/444 |
| 2003/0092515 | A1 | 5/2003 | Darnell | |

* cited by examiner

THROWN FLYING TOY THAT PRODUCES LIFT REGARDLESS OF DIRECTION OF ROTATION

RELATED APPLICATIONS

This application claims priority of provisional patent application No. 62/615,428 filed Jan. 9, 2018.

BACKGROUND OF THE INVENTION

1. Field of the Invention

In general, the present invention relates to flying toys, such as flying discs and boomerangs that are thrown into flight while rotating. More particularly, the present invention relates to flying toys that have a plurality of air foils or wings that radially extend from a common hub.

2. Prior Art Description

There are many flying toys that are thrown into flight with a rotating motion. The two most common flying toys are boomerangs and flying discs.

Boomerangs have wings that are symmetrically disposed around a central point. Each of the wings is shaped to create lift when rotating in one direction. As a consequence, when the boomerang is thrown, its rotation creates lift and enables the boomerang to fly. It will be understood that lift is created only if the boomerang is thrown with a particular rotation. If the boomerang is thrown with an opposite rotation, no lift is generated, and the boomerang will not fly very far.

Flying discs, such as the Frisbee®, are also designed to be thrown into flight while rotating. However, the mechanism of flight is different from that of a boomerang. When a flying disc is thrown into flight, it is thrown at a slight angle of inclination. As such, the body of the flying disc catches the air in the same manner as does a kite or a sail. The rotation of the flying disc creates a gyroscopic effect that helps to keep the flying disc stable in flight. As such, the flying disc can remain stable in flight as it flies from one point to another.

In the toy industry, hybrid flying toys have been created that have some aerodynamic features of a flying disc and some aerodynamic features of a boomerang. In such hybrid designs, wings are attached to a central ring. The central ring catches air like a flying disc and the wings create lift like a boomerang. Such prior art is exemplified by U.S. Pat. No. 4,479,655 to Adler, U.S. Pat. No. 4,203,249 to Bohm, and U.S. Patent Application Publication No. 2003/0092515 to Darnell. In other hybrid designs, wings are connected together to form a ring. The ring both catches air and creates lift. Such prior art is exemplified by U.S. Pat. No. 5,213,539 to Adler and U.S. Pat. No. 4,307,535 to Martin. If the wing elements in such hybrid designs are intended to create lift in flight, they still only create lift when rotating in one particular direction. If the hybrid is thrown with the wrong rotational direction, no lift is created, and it flies as an inert disk.

A need therefore exists for a flying toy that creates lift like a boomerang and has the directional and flight stability of a flying disc, yet flies equally well regardless of its direction of rotation in flight. This need is met by the present invention as described and claimed below.

SUMMARY OF THE INVENTION

The present invention is a flying toy that is thrown into flight. The toy creates lift as it rotates, regardless to the direction of rotation. The flying toy has a central hub that is symmetrically disposed about an imaginary central axis. A central opening is formed in the hub that is concentric with the central axis. The central opening is large, having a diameter that is at least as wide as twenty percent the overall width of the flying toy.

A plurality of wings radially extends from the central hub in a pattern that is symmetrically disposed about the central axis. Each of the plurality of wings has a first section that extends from the hub, a second section that extends from the hub, and a curved section that joins the first section to the second section. A shaped opening is defined in each of the plurality of wings between the hub, the first section, the curved section, and the second section. The shaped opening has an area at least as large as the central opening in the hub.

The curved section in each of the plurality of wings is shaped as an airfoil. As such, the curved sections produce lift as air flows over the curved sections as the flying toy is in flight. The large openings in the hub and the specialized leading edges of the wings enable air to flow over the air foils regardless to flight speed or rotational speed. The specialized shape of the flying toy's leading edges and its multiple wing sections also produces substantial aerodynamic lift. This further enhances the flight abilities by supplementing the lift created by the airfoil shapes of the curved sections.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

The present invention flying toy can be configured in many ways. For example, the flying toy can be configured with any number of symmetrically spaced wings. Although many such configurations can be produced, only one exemplary embodiment with four specialized wings is illustrated and described. The exemplary embodiment is selected in order to set forth one of the best modes contemplated for the invention. The illustrated embodiment, however, is merely exemplary and should not be considered a limitation when interpreting the scope of the appended claims.

Figure 1:
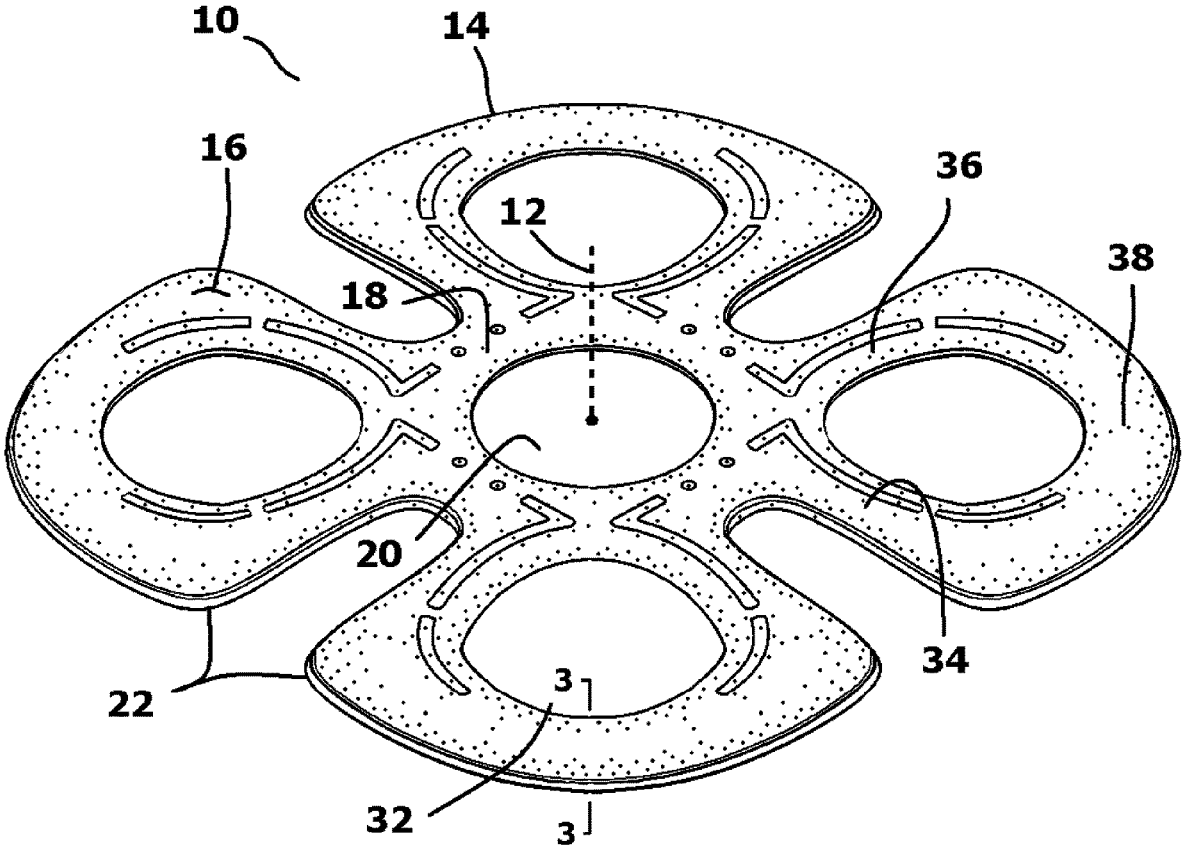
FIG. 1 is a perspective view of an exemplary embodiment of the present invention flying toy.
Figure 2:
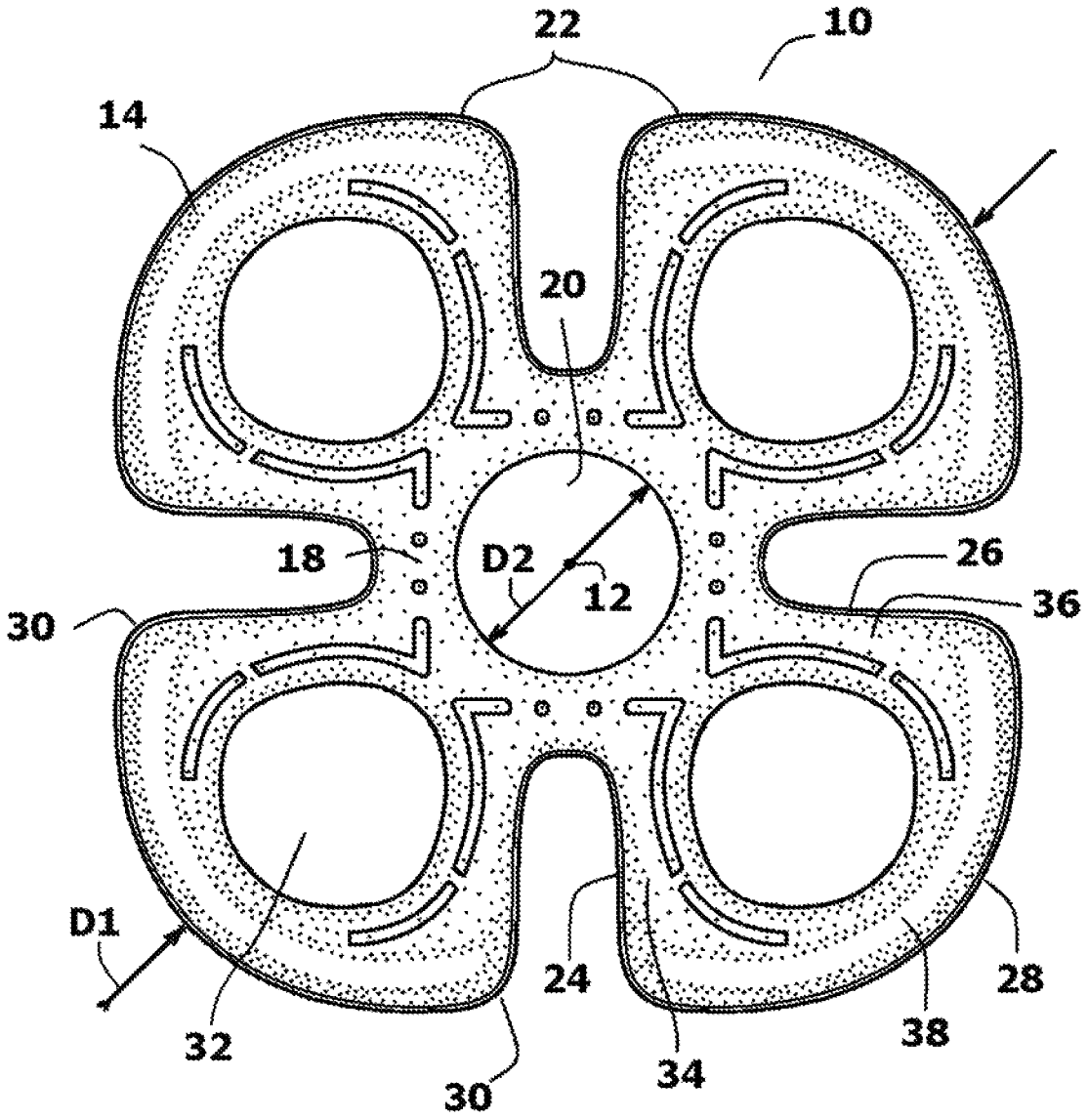
FIG. 2 is a top view of the exemplary embodiment of FIG. 1.

Referring to FIG. 1, and FIG. 2, a flying toy 10 is shown. The flying toy 10 is held in one hand and is thrown into flight in the same manner as a traditional flying disc. As such, when in flight, the flying toy 10 rotates about an imaginary central axis 12 located in its geometric center.

The flying toy 10 has a body 14. The body 14 has a maximum diameter D1. As will later be explained, the body 14 has a two-part construction wherein a soft elastomeric material 16 is over-molded onto a more rigid core frame.

This provides the flying toy 10 with a soft exterior that is easy to grip and is not likely to cause impact damage. The body 14 of the flying toy 10 is symmetrically formed around the central axis 12. In this manner, the body 14 is stable when rotating about the central axis 12 in flight. The flying toy 12, therefore, does not wobble in flight and will have a constant, straight and stable flight profile.

The body 14 of the flying toy 10 has an annular hub 18 that defines a center opening 20. The center opening 20 is round and has a diameter D2 that is at least as long as twenty percent of the overall diameter D1 of the body 14. The central axis 12 extends through the center of the center opening 20. A plurality of specialized wings 22 radially extend from the central hub 18 in a pattern that is symmetrically disposed about the central axis 12. Each of the specialized wings 22 is identical in size, shape, and weight. In this manner, when the flying toy 10 is rotating about the central axis 12, the flying toy 10 remains balanced and stable. Each specialized wing 22 has a periphery consisting of with a first straight side 24 and a second straight side 26. The first straight side 24 and the second straight side 26 are joined by a curved leading edge 28. The first straight side 24 and the second straight side 26 are oriented between 80 degrees and 110 degrees apart, with a preferred relative angle of approximately 90 degrees. This provides each specialized wing 22 with a shape that has two salient points 30 along its periphery edge that are joined by the curved leading edge 28.

The specialized wings 22 are not solid. Rather each of the specialized wings 22 defines a shaped opening 32 that is formed in the center of each of the specialized wings 22. Each shaped opening 32 has an area that is equal to or greater than the area of the center opening 20 in the center of the hub 18. The shaped opening 32 divides each of the specialized wings 22 into three sections 34, 36, 38. The first section 34 exists between the shaped opening 32 and the first straight side 24. The second section 36 exists between the shaped opening 32 and the second straight side 26. The third section 38 exists between the shaped opening 32 and the curved leading edge 28, wherein the third section 38 is the farthest from the central hub 18.

The shaped openings 32 in each of the specialized wings 22 are not round. Rather, the shaped openings 32 are slightly oblong in order to ensure that the minimum width W1 of the first section 34, the second section 36 and the third section 38 of the specialized wings 22 are equal.

Figure 3:
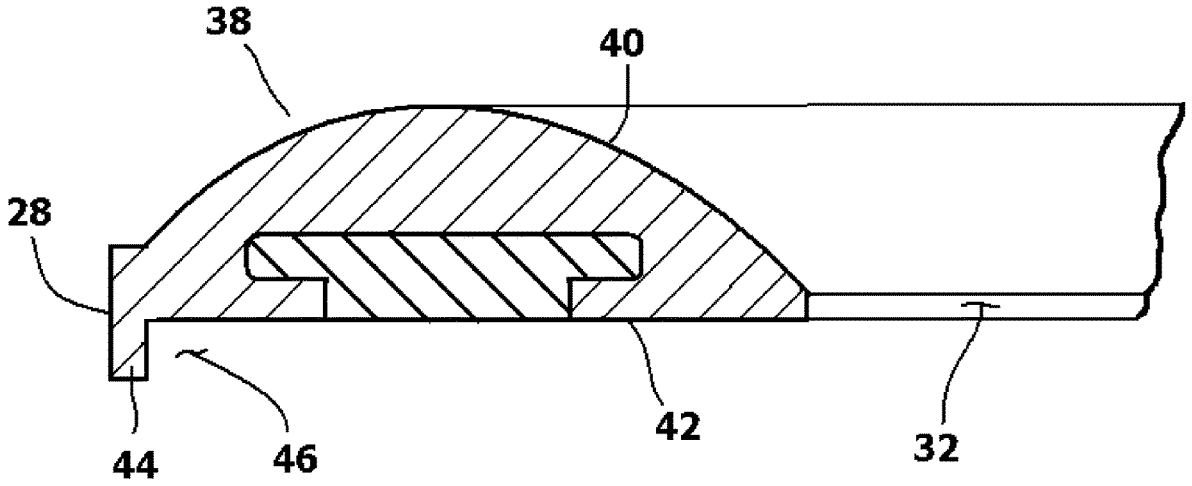
FIG. 3 is cross-sectional view of a segment of the flying toy as viewed along line 3-3 in FIG. 1.

Referring to FIG. 3 in conjunction with FIG. 1 and FIG. 2, it can be seen that the third section 38 of each specialized wing 22 has a protruding upper camber 40, so as to form an airfoil. The applicant refers to the configuration creates by the protruding upper camber 40 as a "turbulator". Below the protruding upper camber 40 is a nearly flat bottom surface 42 that acts as the chord of the airfoil. The result is an aerodynamically lifting airfoil shape that produces lift as air passes over the protruding upper camber 40. Lift is produced regardless of whether air is flowing from the shaped opening 32 to the curved leading edge 28 or vice versa. The lift that is produced is created by the relative movement of the flying toy 10 through space. No substantial lift is created by the rotational movement of the flying toy 10 around the central axis 12. Additionally, the spinning nature of the flying toy 10 does create additional lift as the symmetrical wings 22 are traveling both in forward motion and a spinning motion. The spinning motion enhances the forward lifting aspects. Both the spin and the throw directional speed (either left or right spinning) crates lift over the airfoils sections. As such, the same amount of lift is created if the flying toy 10 is thrown with a clockwise rotation or a counter-clockwise rotation.

A lip 44 extends downwardly from the curved leading edge 28 of the third section 38. The lip 44 helps define a recessed area 46 under each of the extending wings 22. The recessed areas 46 "turbulates" or slightly disrupts the air at the leading edge and airfoil surface level thus gaining performance retaining laminar airflow across the entire airfoil at any speed, like an airplane wing when the flying toy 10 is in flight. This enables the flying toy 10 to better produce lift.

Figure 4:
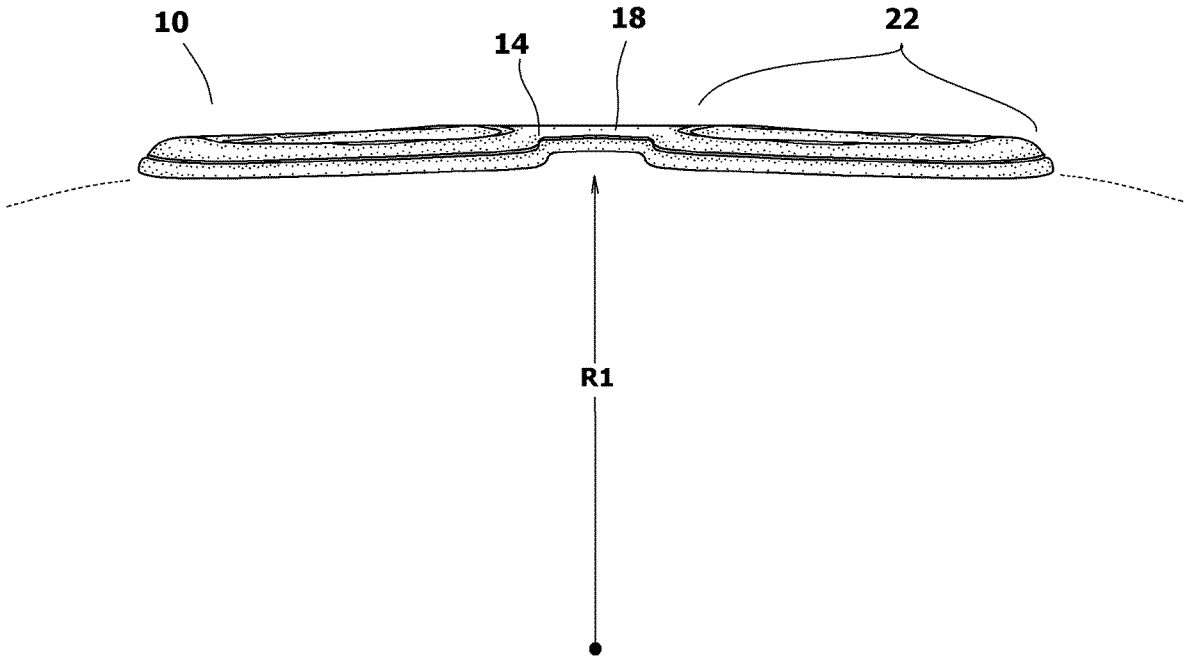
FIG. 4 is a side view of the exemplary embodiment of FIG. 1.

Referring to FIG. 4, it can be seen that the body 14 of the flying toy 10 is not planar. Rather, the body 14 is slightly curved between opposing ends when viewed from a side edge. The extending wings 22 radially extend from the central hub 18 following a curved plane that has an apex at the central axis 12.

The slight curvature follows a radius R1 that is at least as large as the diameter D1 of the flying toy 10. The slight curvature causes the lift forces created by the specialized wings 22 to diverge away from the central axis 12. This results in more stable flight characteristics at all rotational speeds.

Figure 5:
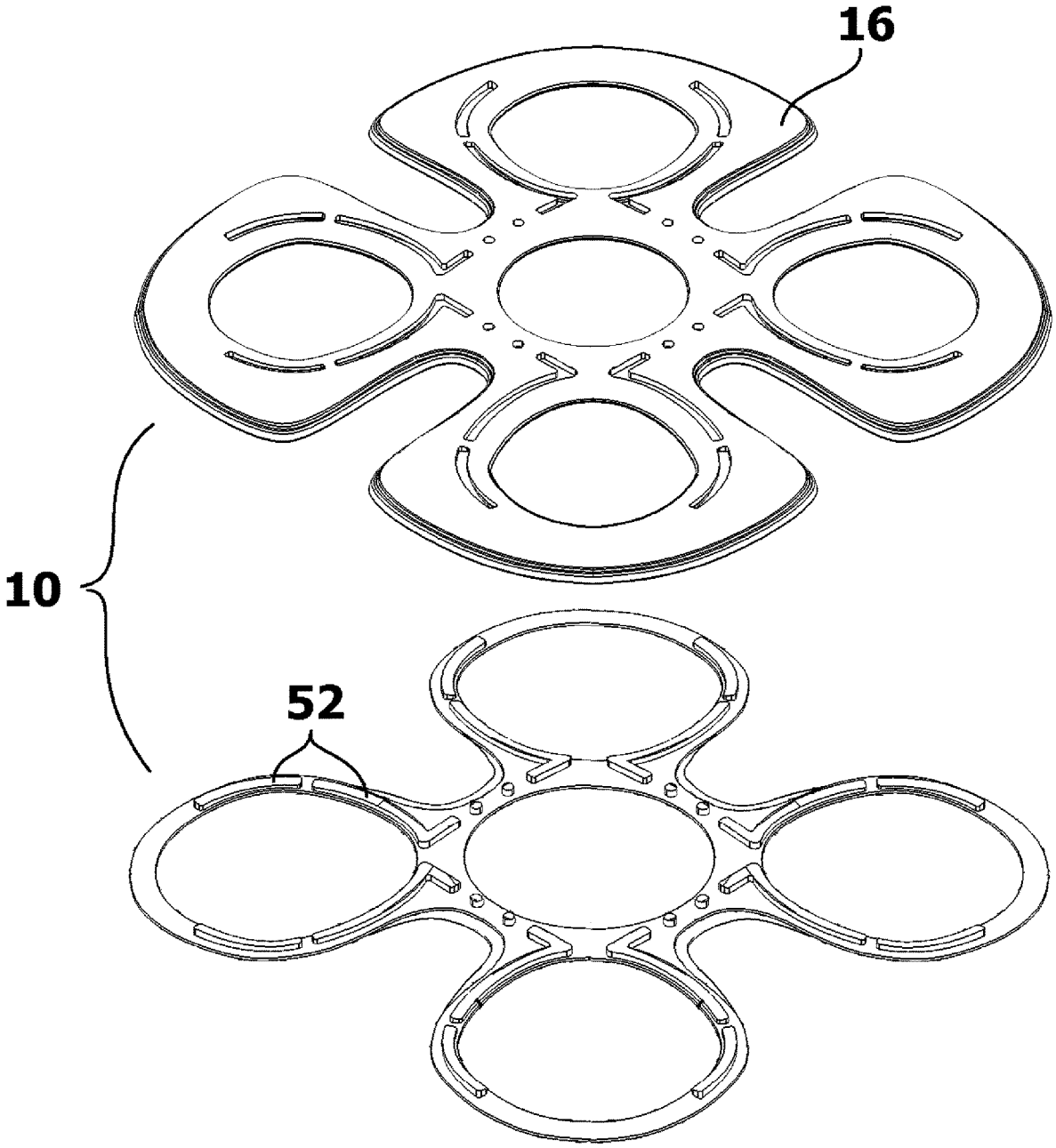
FIG. 5 is an exploded view of the exemplary embodiment of FIG. 1.
Figure 6:
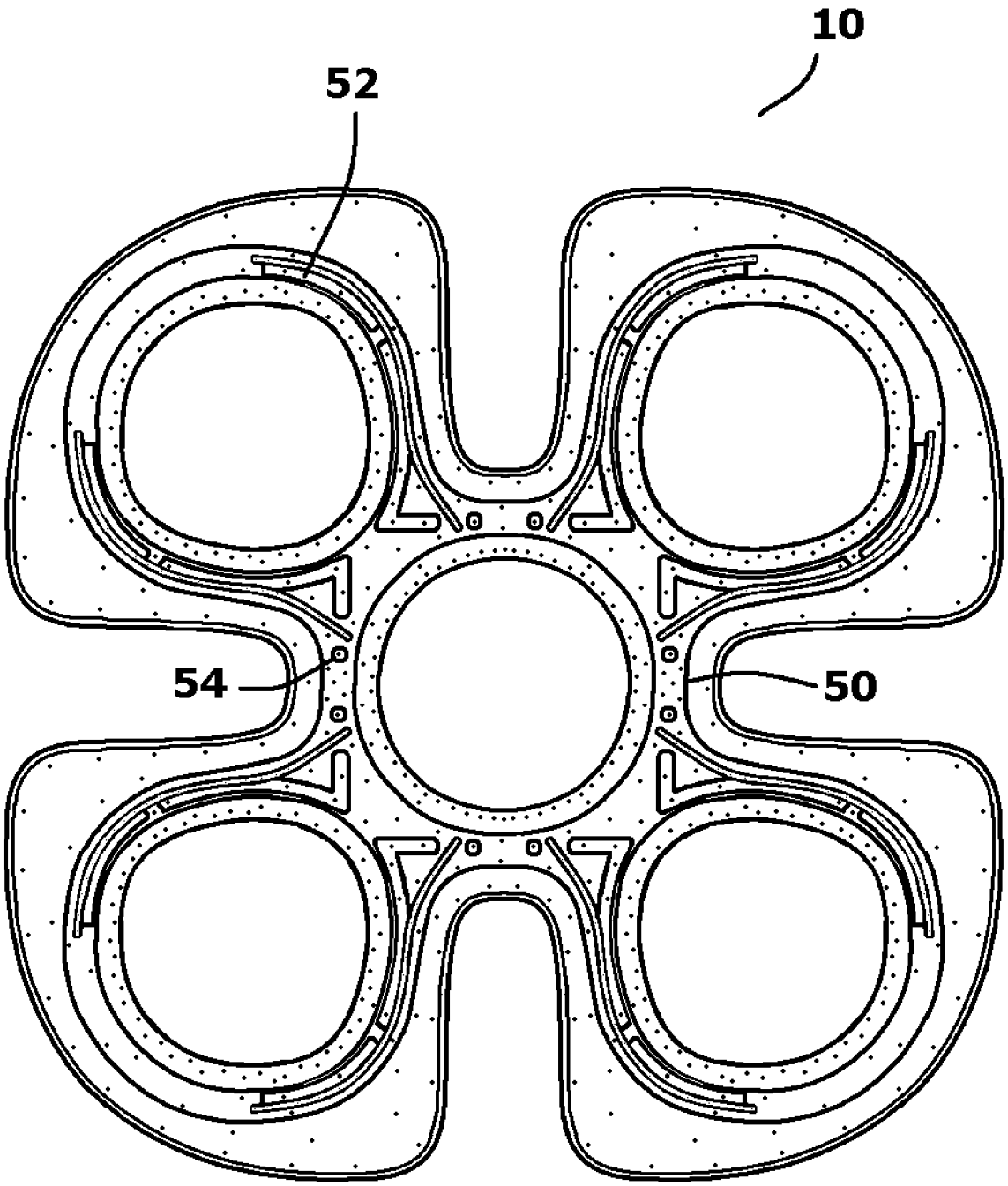
FIG. 6 is a fragmented bottom view of a specialized wing on the exemplary embodiment of the flying toy.

Referring to FIG. 5 and FIG. 6 in conjunction with FIG. 2, it can be seen that the flying toy 10 has a core frame 50 that is molded from a strong plastic. The core frame 50 provides structural integrity to the flying toy 10 and maintains the shape of the flying toy 10, both while the flying toy 10 is in flight and while the flying toy 10 is being caught and thrown.

The core frame 50 is formed with multiple projecting rails 52. Optional through holes may also be provided. An elastomeric material 16 is molded around the core frame 50 to complete the shape of the flying toy 10. The elastomeric material 16 can be a thermoplastic rubber or a polymer foam material that is bond compatible to the core frame 50. During the over-molding process, the elastomeric material 16 flows around the rails 52 and into any holes present in the core frame 50. This creates a mechanical bond between the core frame 50 and the over-molded elastomeric material 16 that can resist any bending or flexing of the flying toy 10. Additionally, by molding the core frame 50 from one color and over-molding elastomeric material 16 of a second color, decorative patterns 56 can be achieved in the flying toy 10 where the projecting rails 52 of the core frame 50 is exposed on the exterior of the flying toy 10.

With reference to all figures, it will be understood that any of the extending wings 22 can be grasped and the flying toy 10 thrown in flight with a rotation. As the flying toy 10 flies in a particular direction, air flows over the airfoil sections 38 of the extending wings 22 that are facing and trailing the line of flight. This creates lift. Simultaneously, the recessed areas 46 under each extending wing 22 "turbulates" or produces laminar air flow, creating a more efficient air cushion that further prolongs flight. The result is a strong, lightweight flying toy 10 that has a soft exterior and is capable of maintaining prolonged periods of flight from a single throw.

It will be understood that the embodiment of the present invention that is illustrated and described is merely exemplary and that a person skilled in the art can make many variations to that embodiment. All such embodiments are intended to be included within the scope of the present invention as defined by the appended claims.

What is claimed is:

1. A flying toy, comprising:

a central hub symmetrically disposed about an imaginary central axis;

a plurality of wings radially extending from said central hub in a pattern symmetrically disposed about said central axis, each of said plurality of wings being separate and distinct other than being connected by said central hub, wherein each of said plurality of wings has a first section that extends from said hub, a second section that extends from said hub, and a curved section that joins said first section to said second section, wherein a shaped opening is defined in each of said plurality of wings between said hub, said first section, said curved section, and said second section; and wherein only said curved section on each of said plurality of wings is an airfoil that produces lift when said plurality of wings are in flight.

2. The flying toy according to claim 1, wherein a central opening is formed in said hub that is concentric with said central axis.

3. The flying toy according to claim 2, wherein said plurality of wings extend a first distance apart on opposite sides of said hub, wherein said central opening has a diameter that is at least twenty percent as long as said first distance.

4. The flying toy according to claim 3, wherein each said shaped opening in said plurality of wings has an area at least as large as said central opening.

5. The flying toy according to claim 1, wherein each said curved section of said plurality of wings terminates along a leading edge, wherein a lip extends from said leading edge in a direction parallel to said central axis.

6. The flying toy according to claim 1, wherein said plurality of wings radially extends from said central hub following a curved plane that has an apex at said central axis.

7. The flying toy according to claim 6, wherein said plurality of wings extends a first distance apart on opposite sides of said hub, wherein said curved plane has a radius of curvature at least as large as said first distance.

8. The flying toy according to claim 1, further including a core frame molded of a first plastic and an exterior overmold of a second plastic, wherein said core frame and said exterior overmold form said central hub and said plurality of wings.

9. The flying toy assembly according to claim 8, wherein said core frame contains openings through which said second plastic can flow, therein mechanically joining said exterior overmold to said core frame.

10. The flying toy assembly according to claim 8, wherein said second plastic is a soft elastomeric material.

11. A flying toy, comprising:

a central hub symmetrically disposed about an imaginary central axis;

a plurality of wings radially extending from said central hub in a pattern symmetrically disposed about said central axis, wherein each of said plurality of wings has a shaped opening defined by a first section that extends from said hub, a second section that extends from said hub, and a curved section that joins said first section to said second section, wherein on each of said plurality of wings only said curved section is an airfoil that creates aerodynamic lift as said flying toy progresses through air.

12. The flying toy according to claim 11, wherein a central opening is formed in said hub that is concentric with said central axis.

13. The flying toy according to claim 12, wherein said plurality of wings extend a first distance apart on opposite sides of said hub, wherein said central opening has a diameter that is at least twenty percent as long as said first distance.

14. The flying toy according to claim 13, wherein each said shaped opening in said plurality of wings has an area at least as large as said central opening.

15. The flying toy according to claim 11, wherein a lip extends from said leading outer edge of each of said plurality of wings in a direction parallel to said central axis.

16. The flying toy according to claim 11, wherein said plurality of wings radially extends from said hub following a curved plane that has an apex at said central axis.

17. The flying toy according to claim 16, wherein said plurality of wings extend a first distance apart on opposite sides of said hub, and wherein said curved plane has a radius of curvature at least as large as said first distance.

18. The flying toy according to claim 11, further including a core frame molded of a first plastic and an exterior overmold of a second plastic, wherein said core frame and said exterior overmold form said central hub and said plurality of wings.

19. The flying toy according to claim 18, wherein said core frame contains openings through which said second plastic can flow, therein mechanically joining said exterior overmold to said core frame.

* * * * *